United States Patent [19]

Rich

[11] 4,269,311

[45] May 26, 1981

[54] PORTABLE HAND CARRIED KIT FOR A SET OF WRENCHES AND THE LIKE

[76] Inventor: Jackson E. Rich, 405 S. Wyandotte, Bartlesville, Okla. 74003

[21] Appl. No.: 89,382

[22] Filed: Oct. 30, 1979

[51] Int. Cl.[3] ..... B65D 85/28

[52] U.S. Cl. ..... 206/234; 206/376; 81/177 A; 81/177 E

[58] Field of Search ..... 206/234, 376, 377; 81/177 R, 177 A, 177 E, 177 M, 177 N, 177 ST, 119

[56] References Cited

U.S. PATENT DOCUMENTS

| | | | |
|---|---|---|---|
| 2,412,056 | 12/1946 | Mosch | 206/234 |
| 2,503,380 | 4/1950 | Derby | 206/234 |
| 2,701,052 | 2/1955 | Martel | 206/377 |
| 3,323,638 | 6/1967 | Dishart | 206/234 |

*Primary Examiner*—Joseph Man-Fu Moy
*Attorney, Agent, or Firm*—W. Britton Moore

[57] ABSTRACT

A portable hand carried kit for a set of wrenches or similar small tools including a hollow elongated case having a hinged cover. A nest of varying sized and shaped wrenches and the like are housed in parallel relation within and pivotally mounted on a pin extending transversely of and approximately midway of the case and wherein one end of the case and its cover has at least a two-stepped opening therein, whereby a selected tool may be pivotally moved to project through its aligned stepped opening and is supported and clamped therein when the cover is closed and secured to the case so that the latter functions as a handle for the tool during use thereof.

3 Claims, 6 Drawing Figures

PORTABLE HAND CARRIED KIT FOR A SET OF WRENCHES AND THE LIKE

BACKGROUND OF THE INVENTION

This invention relates to a portable hand carried kit for a set of wrenches and other small tools.

While various handling kits for tools have heretofore been proposed, such as those represented by U.S. Pat. Nos. to Minges 1,369,829, Derby 2,503,380, Rolland 2,786,380, and Kuc 2,804,970, such kits have not so supported and clamped the tool selected for use therein to enable the kit to function as a handle during use of the tool.

SUMMARY OF THE INVENTION

The principal object of the present invention is to provide a portable hand carried hinged cover kit for a set of varying sized wrenches and the like pivotally mounted therein, and selectively pivotally projectable through a stepped opening in one end of the kit casing, when the cover is opened, so as to be clamped therein, upon closing of the cover, to enable the casing to function as a handle for tool use.

Another object is the provision of a hand carried kit having a hinged cover for housing a set of elongated parallely disposed varying sized wrenches and the like pivotally mounted on a transversely extending pin therein, and wherein one end of the casing and cover is formed with at least two matching stepped exit openings through which the wrenches may selectively project, when pivoted on the pin after opening of the cover, so that when the cover is closed and secured, the selected wrench will be clamped in its matching exit opening and the casing hand grasped for manipulating the wrench during use.

A further object is to provide a hollow elongated case with hinged cover and wherein a series of varying sized wrenches and the like are pivotally mounted therein for selective projection through a stepped opening in one end of the case and cover, and wherein the case and cover are contoured to facilitate hand grasping of the tool.

These and other objects and advantages will be apparent as the specification is considered with the accompanying drawings wherein FIG. 1 is a perspective view of the kit with the cover closed, and a selective wrench projecting through one of the stepped openings in work performing position;

DETAILED DESCRIPTION

Figure 1:
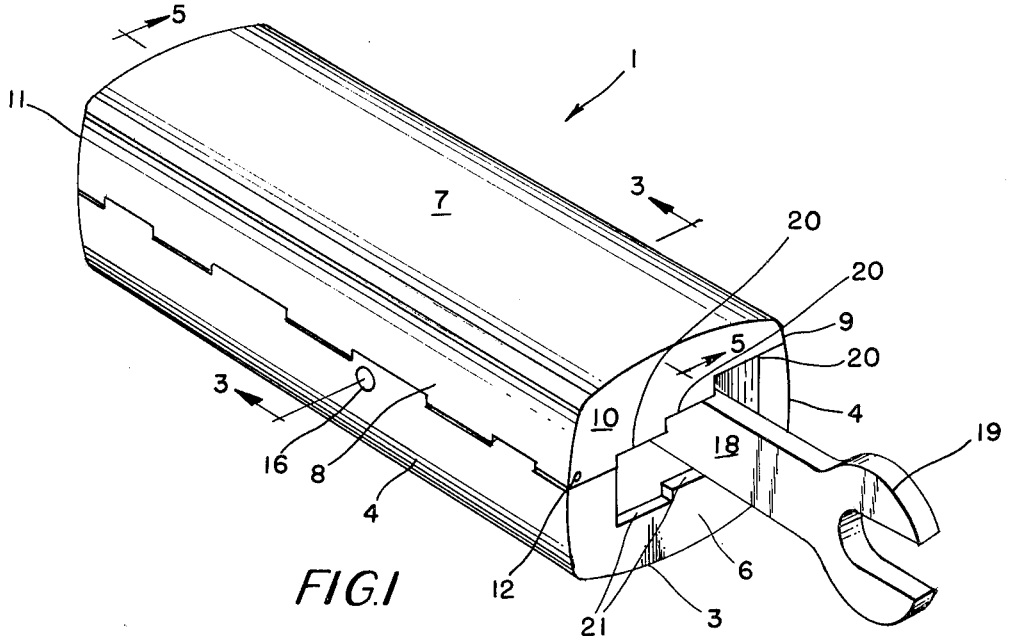

Referring more specifically to the drawings, wherein similar reference characters designate like parts throughout the several views, numeral 1 generally denotes an elongated hollow casing preferably formed with a one-piece body portion 2, generally U-shaped in cross section, so that a bottom wall 3 thereof is convex and its side walls 4 generally extend upwardly therefrom. The ends of body portion 2 are closed by flat end walls 5 and 6. A similarly shaped inverted generally U-shaped cover 7, having side walls 8–9 and flat end walls 10 and 11, is suitably hingedly attached, as at 12, to the upper end of side wall 4. Any suitable hook means, such as a downwardly depending and curved hook 13, is pivotally connected, as at 14, to side wall 8 of the cover and swingably engages with a pin 15 projecting from side wall 4, serves to retain the cover in closed position, in an obvious manner.

Figure 5:
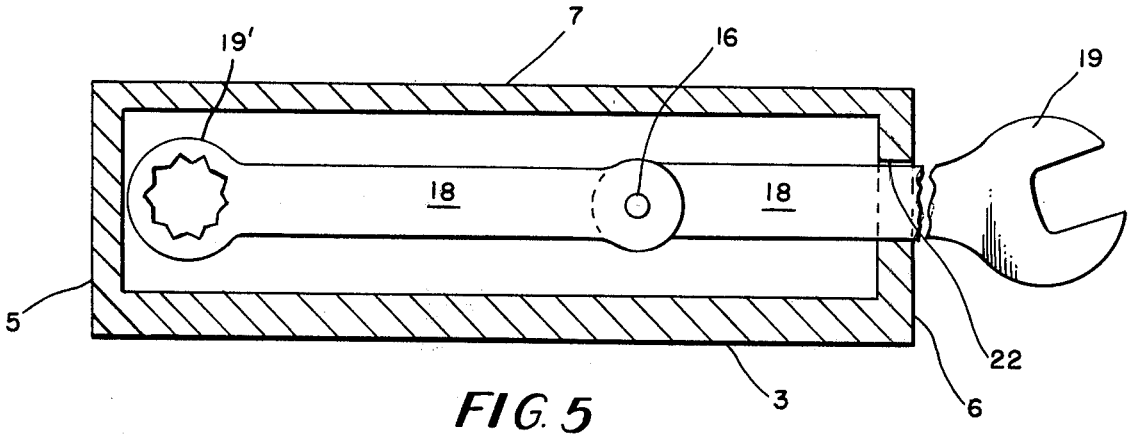
FIG. 5 is a section on the line 5—5 of FIG. 1, showing a crescent type wrench in extended operative position and a box end wrench housed therein.
Figure 6:
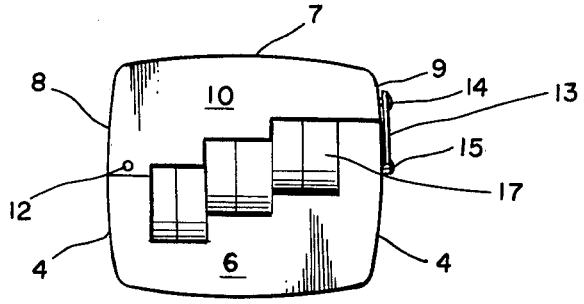
FIG. 6 is an end view of the kit, showing the wrenches fully housed therewithin.

Anchored in side walls 4, at a point intermediate their length and spanning the casing, is a pin 16 upon which is pivotally mounted a nested series of elongated, varying sized and shaped wrenches or similar implements 17 embodying flat shanks 18 and, in the case of wrenches, the usual slotted or crescent type wrench head 19 or box end head 19' formed on one end of each, as shown in FIGS. 1 and 5. For example, six wrenches are preferably mounted within the casing, with alternate wrenches including ½, 7/16, and ⅜ inch box ends, and those in between being similar sized crescent wrenches. A lower edge 7' of one end wall of cover 7 is offsettedly recessed to form at least two transversely extending steps 20, with three being shown in FIG. 1, and which decrease in height from left to right, as shown therein. Formed in casing end wall 6, by similarly offsettedly recessing the upper edge 6' thereof, are at least two similarly transversely extending steps 21, with three also being shown in FIG. 1. Steps 21 increase in height from left to right, referring to FIG. 1, so as to respectively parallel the steps 20 in the cover end wall and provide openings 22 in one end of the end casing generally uniform and of the same size and shape, for a purpose presently to be described.

Figure 3:
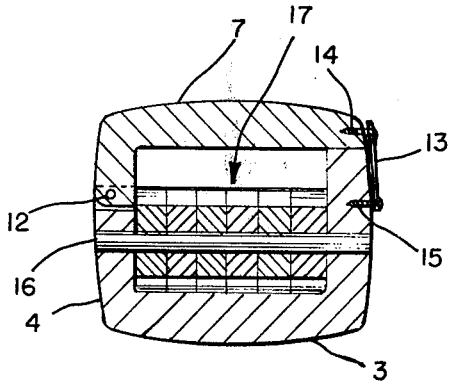
FIG. 3 is a section on the line 3—3 of FIG. 1.
Figure 4:
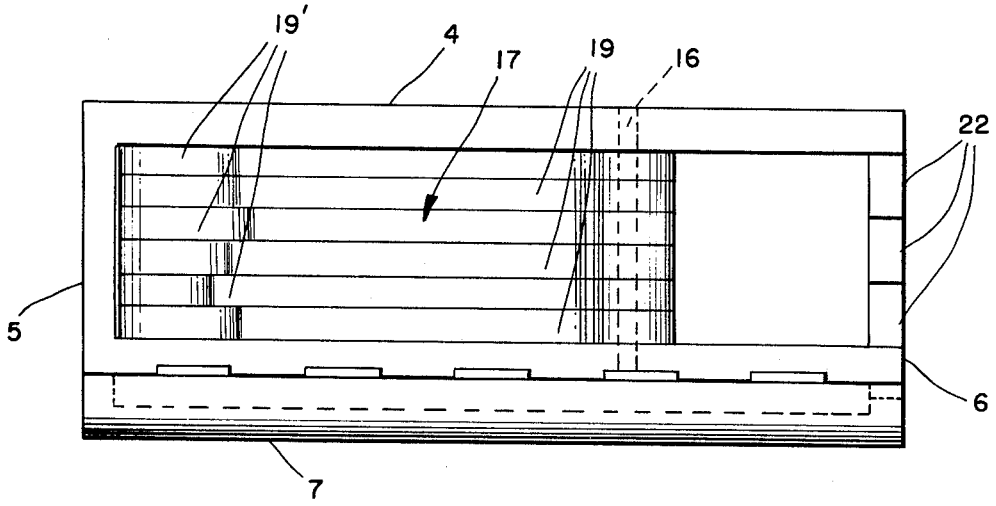
FIG. 4 is a top plan view of the kit, with the cover in open position, and the wrenches housed therein.

As best shown in FIG. 3, the flat shanks 18 of the wrenches 17 are pivotally mounted on pin 16 at points closer to the rear ends thereof so as to flatly engage and parallel each other, and to enable the wrenches to be pivoted inwardly for housing within the casing, at which time the cover may be closed and latched for storage purposes. When mounted on pivot pin 16, the wrench shanks 16 will be edgewise disposed within the casing, and are so dimensioned as to thickness as to be so arranged in pairs as to fully occupy the width of the casing and cover and be engaged at either side by the side walls 4 and 8–9 thereof. When the cover 7 is opened, the shanks may be pivoted upwardly and outwardly so that each pair thereof will be adapted to project through the stepped openings in casing end wall 6. Thus, when the cover is closed and latched, each pair of shanks will project through and generally fit and conform to the contour of each of the offset or stepped openings 22, formed by the recessed end walls of the cover and casing. While the number of shanks and implements mounted on pivot 16 may vary, there should be at least one implement for each opening. For example, in FIG. 3, six shanks may be arranged on the pivot 16, with the latter projecting therethrough at successively decreasing levels, so that the first pair is approximately centerwise pivoted, the middle pair at points slightly below the centers, and the third pair at points adjacent one side edge thereof.

Figure 2:
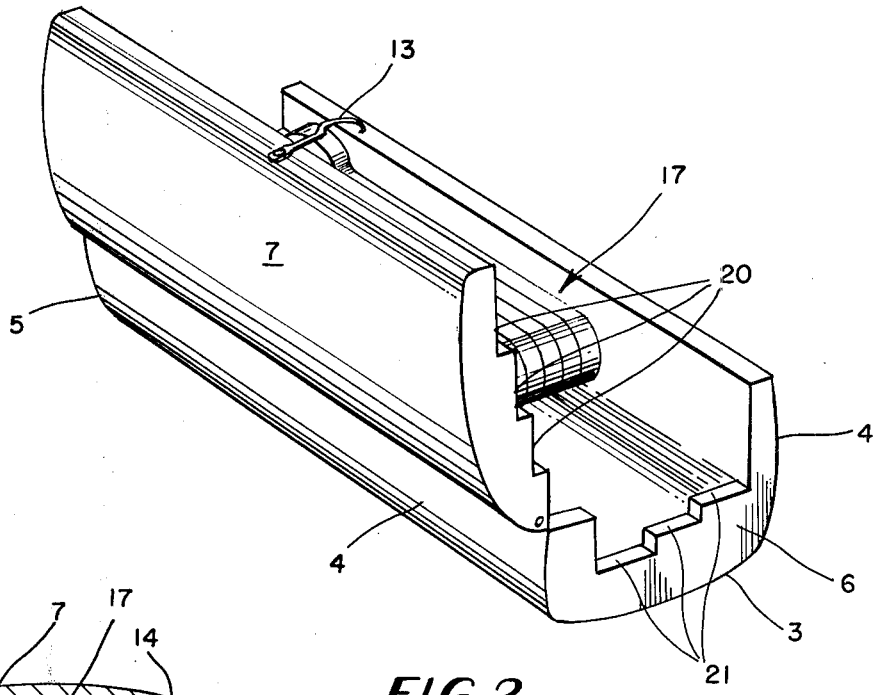
FIG. 2 is a perspective view of the kit, with the cover opened, and the set of wrenches and the like in housed stored position therein.

Referring to FIG. 2, it will be understood that, as the wrench heads vary in size and shape, to enable different work to be performed, only one selected wrench at a time adaptable to that work will be pivotally moved to project through its particular stepped opening. When so disposed, the upper and lower edges of that shank will flatly engage with and be securely clamped in this opening by the steps or recesses 20–21 in the cover and casing end walls, at which time the opposing or inner ends of the shanks are nested between and securely held in position by the remaining shanks. Thus, the closed and latched combined casing and cover may be grasped and readily manipulated to perform that work to which the wrench head or the like is applied.

While a preferred embodiment of hand carried kit has been shown and described, wherein at least two stepped openings are arranged in one end of the casing and cover thereof, so as to house a series of nested varying sized and shaped wrenches or tools therein, it is to be understood that various other changes and improvements may be made therein without departing from the scope and spirit of the appended claims. For example, should a smaller kit with one or two wrenches or tools be desired, the casing and cover could be narrowed and only a single generally square-shaped opening provided in one end thereof to enable pivoting of that tool or tools therethrough.

What I claim is:

1. In a hand carried kit of the character described, a generally U-shaped elongated hollow body portion with end walls, a generally inverted U-shaped cover hingedly mounted on said body portion and having end walls, one end wall of each of said body portion and cover at the same end being provided with at least two matching openings arranged therein and extending transversely thereof in stepped arrangement, a pivot pin extending transversely of said body portion, a series of elongated generally flat shanks for wrenches and the like having varying sized and shaped heads on one end of each, said shanks being pivotally mounted and closely nsted on said pin so as to be contained and housed therewithin, said stepped openings being recessed in the respective upper and lower edges of said cover and body portion and successively being laterally offset with respect to each other and alignable to provide a series of generally uniform matched stepped openings, said shanks being alignable with said stepped openings through which a selected shank and head may be pivotally moved to project through its aligned stepped opening so as to be engageable therewith and clamped therein upon closing of said cover.

2. In a kit of the character described according to claim 1, wherein said cover has latching means for securing said cover closed with respect to said body portion.

3. In a kit of the character described according to claim 1, wherein said shanks generally fit and conform to the contour of the stepped and offset openings so as to be clamped therein.

* * * * *